US007234788B2

(12) United States Patent
Gardner

(10) Patent No.: US 7,234,788 B2
(45) Date of Patent: Jun. 26, 2007

(54) INDIVIDUAL VOLTAGE TRIMMING WITH WAVEFORMS

(75) Inventor: Deane A. Gardner, Cupertino, CA (US)

(73) Assignee: Dimatix, Inc., Lebanon, NH (US)

( * ) Notice: Subject to any disclaimer, the term of this patent is extended or adjusted under 35 U.S.C. 154(b) by 247 days.

(21) Appl. No.: 10/981,072

(22) Filed: Nov. 3, 2004

(65) Prior Publication Data

US 2006/0092201 A1 May 4, 2006

(51) Int. Cl.
*B41J 29/38* (2006.01)

(52) U.S. Cl. ..... 347/9; 347/10; 347/11

(58) Field of Classification Search ..... 347/9–11
See application file for complete search history.

(56) References Cited

U.S. PATENT DOCUMENTS

| | | | |
|---|---|---|---|
| 5,361,084 | A | 11/1994 | Paton et al. |
| 5,369,420 | A | 11/1994 | Bartky |
| 5,438,350 | A | 8/1995 | Kerry |
| 5,463,414 | A | 10/1995 | Temple et al. |
| 5,463,416 | A | 10/1995 | Paton et al. |
| 5,512,796 | A | 4/1996 | Paton |
| 5,512,922 | A | 4/1996 | Paton |
| 5,663,217 | A | 9/1997 | Kruse |
| 5,731,048 | A | 3/1998 | Ashe et al. |
| 5,779,837 | A | 7/1998 | Harvey |
| 5,837,046 | A | 11/1998 | Schofield et al. |
| 5,842,258 | A | 12/1998 | Harvey et al. |
| 5,843,219 | A | 12/1998 | Griffin et al. |
| 5,855,713 | A | 1/1999 | Harvey |
| 5,910,372 | A | 6/1999 | Griffin et al. |
| 5,959,643 | A | 9/1999 | Temple et al. |
| 5,975,672 | A | 11/1999 | Wen |
| 6,010,202 | A | 1/2000 | Arnott |
| 6,014,153 | A | 1/2000 | Harvey |
| RE36,667 | E | 4/2000 | Michaelis et al. |
| 6,046,822 | A | 4/2000 | Wen et al. |
| 6,089,698 | A | 7/2000 | Temple et al. |

(Continued)

FOREIGN PATENT DOCUMENTS

| | | |
|---|---|---|
| EP | 0 876 915 | 11/1998 |

OTHER PUBLICATIONS

David A. Johns et al., "Analog Integrated Circuit Design" Jon Wiley & Sons, Inc., 1997, pp. 39-42, 396-397 and 398-400.

(Continued)

*Primary Examiner*—Julian D. Huffman
(74) *Attorney, Agent, or Firm*—Fish & Richardson P.C.

(57) ABSTRACT

Apparatus including a plurality of droplet ejection devices, an electric source and a controller. Each droplet ejection device includes switches connected in parallel to a piezoelectric actuator. Each switch includes an input terminal to connect to an input waveform signal, an output terminal to connect to the piezoelectric actuator, a control signal terminal to control a connection of the switch with a control signal, and a resistance between the input terminal and output terminal. The apparatus has a waveform table with information to distribute the input waveform signal to an input of each of the droplet ejection devices. The waveform signal table includes waveform signal information for a step pulse, a sawtooth waveform, and/or a combination of two or more waveform patterns.

19 Claims, 8 Drawing Sheets

U.S. PATENT DOCUMENTS

| | | | | |
|---|---|---|---|---|
| 6,102,513 | A | 8/2000 | Wen | |
| 6,106,092 | A | 8/2000 | Norigoe et al. | |
| 6,123,405 | A | 9/2000 | Temple et al. | |
| 6,193,343 | B1 | 2/2001 | Norigoe et al. | |
| 6,217,141 | B1 * | 4/2001 | Nakamura et al. | 347/10 |
| 6,228,311 | B1 | 5/2001 | Temple et al. | |
| 6,232,135 | B1 | 5/2001 | Ashe et al. | |
| 6,260,951 | B1 | 7/2001 | Harvey et al. | |
| 6,281,913 | B1 | 8/2001 | Webb | |
| 6,286,943 | B1 | 9/2001 | Ashe et al. | |
| 6,312,076 | B1 * | 11/2001 | Taki et al. | 347/10 |
| 6,331,045 | B1 | 12/2001 | Harvey et al. | |
| 6,352,328 | B1 | 3/2002 | Wen et al. | |
| 6,379,440 | B1 | 4/2002 | Tatum et al. | |
| 6,399,402 | B2 | 6/2002 | Ashe et al. | |
| 6,402,278 | B1 | 6/2002 | Temple | |
| 6,402,282 | B1 | 6/2002 | Webb | |
| 6,412,924 | B1 | 7/2002 | Ashe et al. | |
| 6,422,690 | B1 | 7/2002 | Harvey et al. | |
| 6,437,879 | B1 | 8/2002 | Temple | |
| 6,460,991 | B1 | 10/2002 | Temple et al. | |
| 6,476,096 | B1 | 11/2002 | Molloy et al. | |
| 6,505,918 | B1 | 1/2003 | Condie et al. | |
| 6,517,195 | B1 | 2/2003 | Koeda | |
| 6,468,779 | B1 | 5/2003 | Pulman et al. | |
| 6,572,221 | B1 | 6/2003 | Harvey et al. | |

OTHER PUBLICATIONS

U.S. Appl. No. 10/642,951, filed Aug. 18, 2003 "Individual Jet Voltage Trimming Circuitry".

* cited by examiner

INDIVIDUAL VOLTAGE TRIMMING WITH WAVEFORMS

BACKGROUND

The following disclosure relates to droplet ejection devices.

Inkjet printers are one type of apparatus employing droplet ejection devices. In one type of inkjet printer, ink drops are delivered from a plurality of linear inkjet print head devices oriented perpendicular to the direction of travel of the substrate being printed. Each print head device includes a plurality of droplet ejection devices formed in a monolithic body that defines a plurality of pumping chambers (one for each individual droplet ejection device) in an upper surface and has a flat piezoelectric actuator covering each pumping chamber. Each individual droplet ejection device is activated by a voltage pulse to the piezoelectric actuator that distorts the shape of the piezoelectric actuator and discharges a droplet at the desired time in synchronism with the movement of the substrate past the print head device.

Each individual droplet ejection device is independently addressable and can be activated on demand in proper timing with the other droplet ejection devices to generate an image. Printing occurs in print cycles. In each print cycle, a fire pulse (e.g., 150 volts) is applied to all of the droplet ejection devices at the same time, and enabling signals are sent to only the individual droplet ejection devices that are to jet ink in that print cycle.

SUMMARY OF THE INVENTION

The systems and techniques described here relate to features, in general, a method to control a response of a droplet ejection device that includes one or more switches and a piezoelectric actuator. The method involves connecting the switches to the piezoelectric actuator. Each switch includes an input terminal to connect to a waveform signal, an output terminal to connect to the piezoelectric actuator, a control signal terminal to control a connection of the switch with a control signal, and a resistance between the input terminal and output terminal. The method includes selecting a waveform signal to apply to the input terminal of each the switches, and applying the selected waveform signal on the input terminal of each of the switches. Each of the switches are connected at a common output terminal at the piezoelectric actuator. The method also involves controlling the control signal terminal of each switch with the control signal.

Also described is an implementation for an apparatus with a number of droplet ejection devices. Each droplet ejection device has multiple switches connected in parallel to a piezoelectric actuator. Each switch has an input terminal to connect to an input waveform signal, an output terminal to connect to the piezoelectric actuator, a control signal terminal to control a connection of the switch with a control signal, and a resistance between the input terminal and output terminal. The apparatus may include a set waveform information to distribute the input waveform signal to an input of each of the droplet ejection devices. The waveform signal information includes information for a step pulse, a sawtooth waveform, and/or a combination of two or more waveform patterns. The apparatus includes an amplifier connected to the input terminal of at least one of the switches to drive the piezoelectric actuator connected to the output terminal with the input waveform signal. The amplifier is configured to charge and discharge a capacitance of the piezoelectric actuator. The apparatus also has a controller to provide respective charge control signals to respective control signal terminals to control the extent of change in charge on the capacitance for the piezoelectric actuator. The apparatus may include a waveform table associated with the set of waveform information.

In another implementation, a system controls printing of an inkjet printer. The system includes a filter circuit to filter high-frequency signals in input waveform signals, in which the filter circuit provides stable firing waveform signals for an actuator for ink droplet ejection. The filter circuit includes an effective resistance formed from multiple resistors electrically connected in parallel, in which a first end of the parallel connection is connected to an input waveform terminal and a second end of the parallel connection is connected to the actuator for ink droplet ejection. The filter circuit also has multiple switches. At least one switch is configured to connect at least one of the resistors to be in parallel with another resistor, and is configured so that each switch is to be electrically connected in series with a resistor. The system includes a controller to control which of the switches are electrically connected to determine a resistance value for the effective resistance. A frequency response of the filter circuit is related to the effective resistance and a capacitance of the actuator.

Particular implementations may provide one or more of the following advantages. The charging up of an actuator to a desired charge and then disconnecting the electric source can result in power savings in comparison to driving a device to a constant voltage and maintaining the voltage. Individual control can be provided for the charge on devices, the slope of the change in charge, and the timing and slope of discharge to achieve various effects such as uniform droplet volume or velocity and gray scale control. The control circuitry can serve as a low-pass filter for incoming waveforms. The low-pass filter can filter high-frequency harmonics to result in a more predictable and consistent firing sequence for a given input waveform pattern.

Different firing waveforms (e.g., step pulse, sawtooth, etc.) may be applied to an inkjet to produce different responses, and to provide different spot sizes. A field-programmable gate array (FGPA) on a print head can store data for a waveform table of available firing waveforms. Each image scan line packet transmitted from a computer to the print head can include a pointer to the waveform table to specify which firing waveform should be used for that scan line. Alternatively, the image scan line packet could include multiple points, such as one for each nozzle in the scan line, to specify on a nozzle-specific basis which firing waveform should be used to produce the desired spot size. As a result, print control can be increased over the desired spot size.

Each droplet ejection device can include one or more resistances connected in parallel between the electric source and the electrically actuated displacement device. A switch can be placed in the path of the electric source and each of the one or more resistances to control the effective resistance of the parallel resistances when charging the device. Alternatively, the switch may be a field-effect transistor (FET) that has an internal resistance. Each droplet ejection device can include one or more resistances connected in parallel between the discharging electrical terminal and the electrically actuated displacement device. A switch can be placed in the path of the discharging electric terminal and each of the one or more resistances to control the effective resistance of the parallel resistances when discharging the device.

In one implementation, the effective resistance of the resistors that are connected in parallel, Reff, and the capacitance of the printing device can determine the response of the low-pass filter. Because the effective resistance can be adjusted depending on which switches are actively connected in parallel, the time constant of the low-pass filter can vary and the resulting waveform across the capacitor can be adjusted (e.g., shaped) accordingly.

A single waveform can be carried across all of the resistances in each resistor's respective path in which the switch of the path is activated. Alternatively, the path of each resistor may use a different waveform in which the switch of the respective path is activated. In this case, the resultant waveform at the device can be a superposition of multiple waveforms. In this aspect, waveforms can be provided that are not stored in the waveform table. Hence, waveforms can be supplied from waveform data stored in the waveform table, as well as waveforms that are generated as a result of waveforms that are superimposed across a set of parallel resistor paths. As one benefit, the amount of memory to store a waveform table on the print head can be minimized to an amount to generate certain waveform patterns, and the control switches can be use to generate additional waveform patterns. As another benefit, a droplet ejection device can have a response that is trimmed or adjusted based on stored waveform data and/or mechanical data for control switches.

The waveform table can also include several parameters to increase print control, and produce different responses and spot sizes for each print job. These parameters may be based, for example, on different types of substrates (e.g., plain paper, glossy paper, transparent film, newspaper, magazine paper) and the ink absorption rate on those substrates. Other parameters may depend on the type of print head, such as a print head with an electromechanical transducer or piezoelectric transducer (PZT), or a thermal inkjet print head with a heat generating element. The waveform table may have parameters that depend on different types of ink (e.g., photo-print ink, plain paper ink, ink of particular colors, ink of particular ink densities) or the resonant frequency of the ink chamber. The waveform table can have parameters to compensate for inkjet direction variability between ink nozzles, as well as other parameters to calibrate the printing process, such as correcting for differences in humidity.

The details of one or more implementations of the disclosure are set forth in the accompanying drawings and the description below. Other features, and advantages will be apparent from the description and drawings, and from the claims.

DETAILED DESCRIPTION

Figure 1:
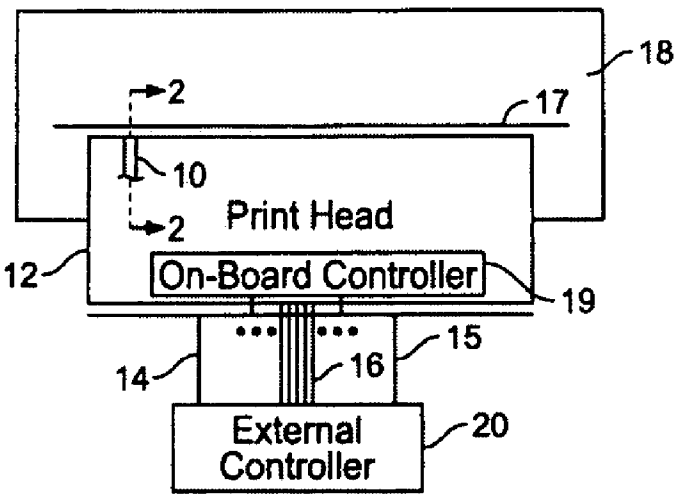
FIG. 1 illustrates a diagrammatic view of components of an inkjet printer.

As shown in FIG. 1, the 128 individual droplet ejection devices 10 (only one is shown on FIG. 1) of print head 12 are driven by constant voltages provided over supply lines 14 and 15 and distributed by on-board control circuitry 19 to control firing of the individual droplet ejection devices 10. External controller 20 supplies the voltages over lines 14 and 15 and provides control data and logic power and timing over additional lines 16 to on-board control circuitry 19. Ink jetted by the individual ejection devices 10 can be delivered to form print lines 17 on a substrate 18 that moves under print head 12. While the substrate 18 is shown moving past a stationary print head 12 in a single pass mode, alternatively the print head 12 could also move across the substrate 18 in a scanning mode.

Figure 2:
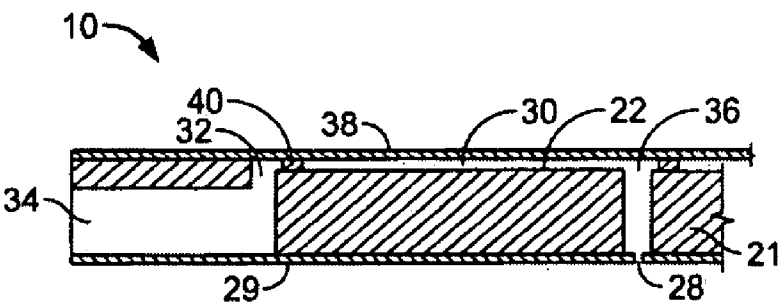
FIG. 2 illustrates a vertical section, taken at 2—2 of FIG. 1, of a portion of a print head of the FIG. 1 inkjet printer showing a semiconductor body and an associated piezoelectric actuator defining a pumping chamber of an individual droplet ejection device of the print head.

Referring to FIG. 2, each droplet ejection device 10 includes an elongated pumping chamber 30 in the upper face of semiconductor block 21 of print head 12. Pumping chamber 30 extends from an inlet 32 (from the source of ink 34 along the side) to a nozzle flow path in descender passage 36 that descends from the upper surface 22 of block 21 to a nozzle opening 28 in lower layer 29. A flat piezoelectric actuator 38 covering each pumping chamber 30 is activated by a voltage provided from line 14 and switched on and off by control signals from on-board circuitry 19 to distort the piezoelectric actuator shape and thus the volume in chamber 30 and discharge a droplet at the desired time in synchronism with the relative movement of the substrate 18 past the print head device 12. A flow restriction 40 is provided at the inlet 32 to each pumping chamber 30.

Figure 3:
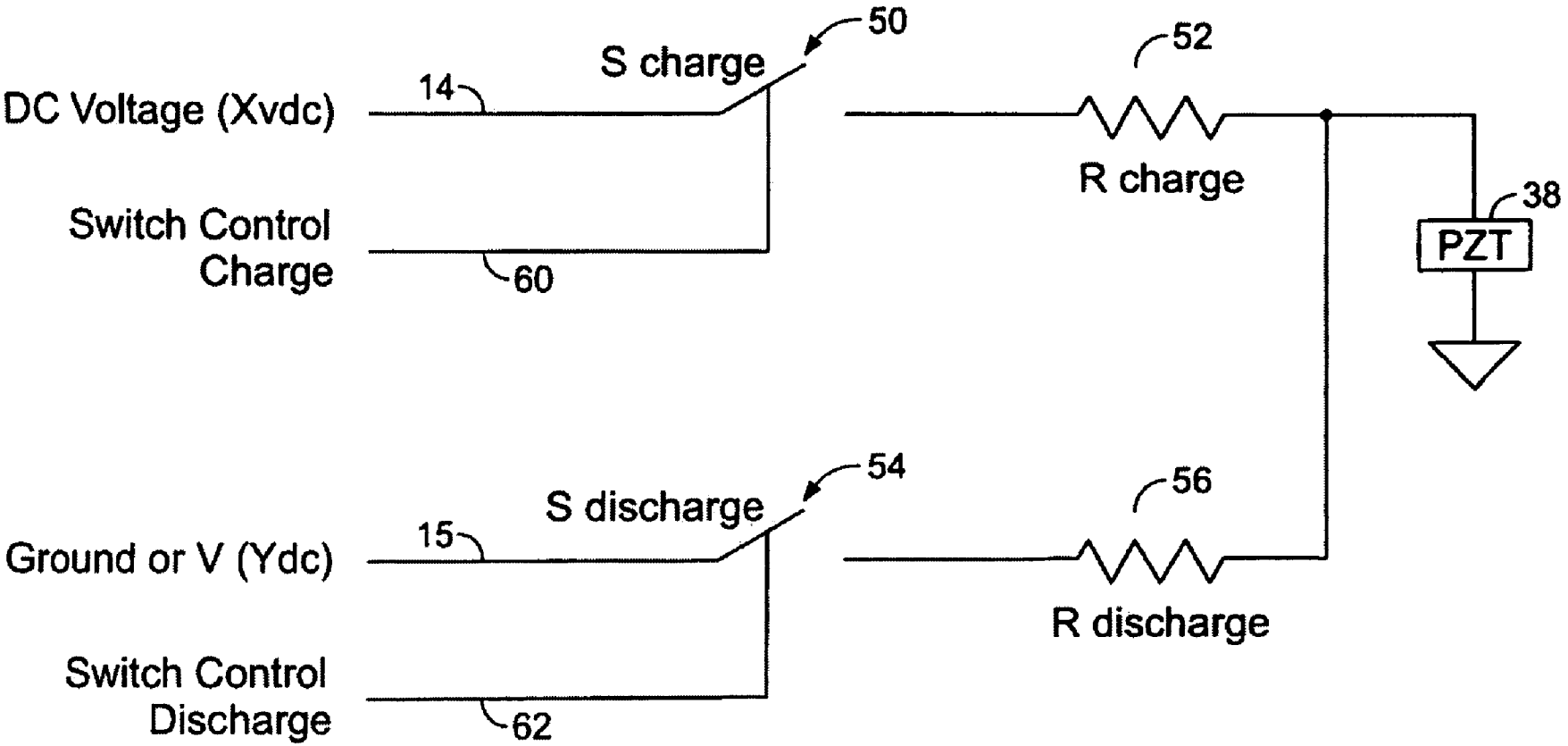
FIG. 3 illustrates a schematic showing electrical components associated with an individual droplet ejection device.

FIG. 3 shows the electrical components associated with each individual droplet ejection device 10. The circuitry for each device 10 includes a charging control switch 50 and charging resistor 52 connected between the DC charge voltage Xvdc from line 14 and the electrode of piezoelectric actuator 38 (acting as one capacitor plate), which also interacts with a nearby portion of an electrode (acting as the other capacitor plate) which is connected to ground or a different potential. The two electrodes forming the capacitor could be on opposite sides of piezoelectric material or could be parallel traces on the same surface of the piezoelectric material. The circuitry for each device 10 also includes a discharging control switch 54 and discharging resistor 56 connected between the DC discharge voltage Ydc (which could be ground) from line 15 and the same side of piezoelectric actuator 38. Switch 50 is switched on and off in response to a Switch Control Charge signal on control line 60, and switch 54 is switched on and off in response to a Switch Control Discharge signal on control line 62.

Figure 4:
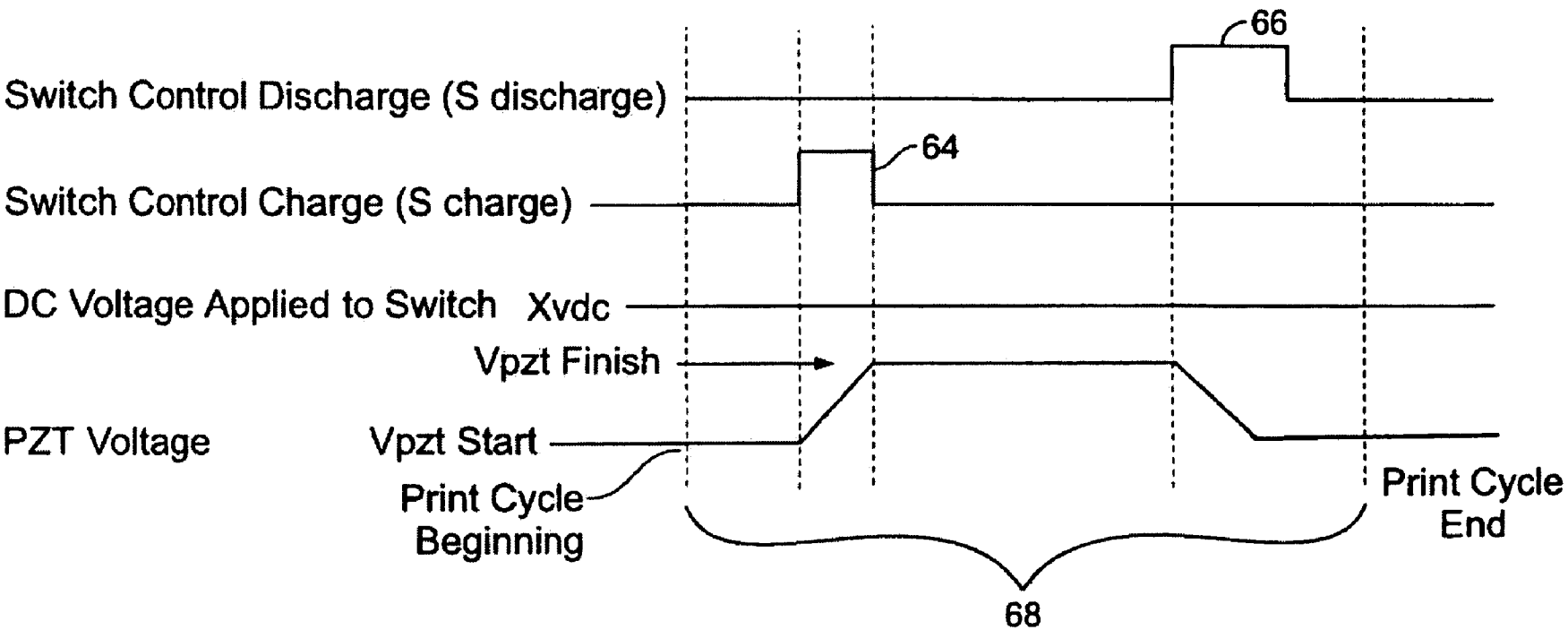
FIG. 4 illustrates a timing diagram for the operation of the FIG. 3 electrical components.

Referring to FIGS. 3 and 4, piezoelectric actuator 38 functions as a capacitor; thus, the voltage across piezoelectric actuator ramps up from Vpzt_start after switch 50 is closed in response to switch charge pulse 64 on line 60. At the end of pulse 64, switch 50 opens, and the ramping of voltage ends at Vpzt_finish (a voltage less than Xvdc). Piezoelectric actuator 38 (acting as a capacitor) then generally maintains its voltage Vpzt_finish (it may decay slightly as shown in FIG. 4), until it is discharged by connection to a lower voltage Ydc by discharge control switch 54, which is closed in response to switch discharge pulse 66 on line 62. The speeds of ramping up and down are determined by the voltages on lines 14 and 15 and the time constants resulting from the capacitance of piezoelectric actuator 38 and the resistances of resistors 52 and 56. The beginning and end of print cycle 68 are shown on FIG. 4. Pulses 64 and 66 are thus timed with respect to each other to maintain the voltage on piezoelectric actuator 38 for the desired length of time and are timed with respect to the print cycle 68 to eject the droplet at the desired time with respect to movement of substrate 18 and the ejection of droplets from other ejection devices 10. The length of pulse 64 is set to control the magnitude of Vpzt, which, along with the width of the PZT voltage between pulses 64, 66, controls drop volume and velocity. If one is discharging to Yvdc the length of pulse 66 should be long enough to cause the output voltage to get as close as desired to Yvdc; if one is discharging to an intermediate voltage, the length of pulse 66 should be set to end at a time set to achieve the intermediate voltage.

In one implementation, the charge voltage applied to droplet ejection device 10 includes a unipolar voltage, in which a DC charge voltage Xvdc is applied at line 14, and a ground potential is applied at line 15. In another implementation, the charge voltage applied to the ejection device 10 includes a bipolar voltage, in which a DC charge voltage Xvdc is applied at line 14 and a DC charge voltage that is opposite in potential (e.g., −Xvdc or 180° difference in phase) is applied at line 15. In another implementation, the charge voltage applied to line 14 could be a waveform. The waveforms may be square pulses, sawtooth (e.g., triangular) waves, and sinusoidal waves. The waveforms can be waveforms of varying cycles, waveforms with one or more DC offset voltages, and waveforms that are the superposition of multiple waveforms.

Different firing waveforms (e.g., step pulse, sawtooth, etc.) may be applied to an inkjet to produce different responses, and provide different spot sizes. A field-programmable gate array (FGPA) on a print head can store a waveform table of available firing waveforms. Each image scan line packet transmitted from a computer to the print head can include a pointer to the waveform table to specify which firing waveform should be used for that scan line. Alternatively, the image scan line packet could include multiple points, such as one for each device in the scan line, to specify on a device-specific basis which firing waveform should be used to produce the desired spot size. As a result, print control can be increased over the desired spot size.

The waveform table can also include several parameters to increase print control, and produce different responses and spot sizes for each print job. These parameters may be based on different types of substrates (e.g., plain paper, glossy paper, transparent film, newspaper, magazine paper) and the ink absorption rate on those substrates. Other parameters may depend on the type of print head, such as a print head with an electromechanical transducer or piezoelectric transducer (PZT), or a thermal inkjet print head with a heat generating element. The waveform table may have parameters that depend on different types of ink (e.g., photo-print ink, plain paper ink, ink of particular colors, ink of particular ink densities) or the resonant frequency of the ink chamber. The waveform table can have parameters to compensate for inkjet direction variability between ink nozzles, as well as other parameters to calibrate the printing process, such as correcting for variations in humidity.

Figure 5:
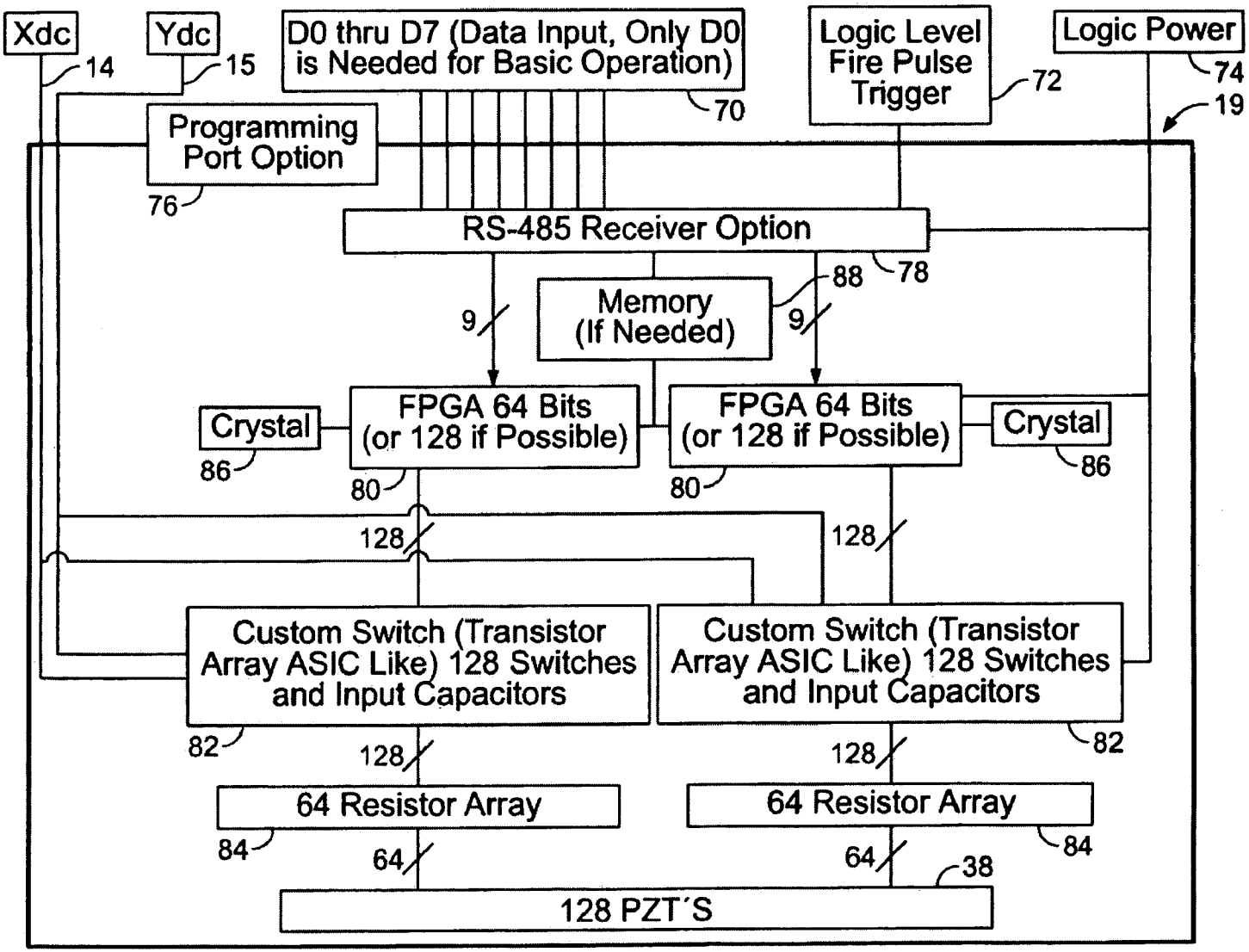
FIG. 5 shows an exemplary block diagram of circuitry of a print head of the FIG. 1 printer.

Referring to FIG. 5, on-board control circuitry 19 includes inputs for constant voltages Xvdc and Ydc over lines 14, 15 respectively, D0–D7 data inputs 70, logic level fire pulse trigger 72 (to synchronize droplet ejection to relative movement of substrate 18 and print head 12), logic power 74 and optional programming port 76. Circuitry 19 also includes receiver 78, field programmable gate arrays (FPGAs) 80, transistor switch arrays 82, resistor arrays 84, crystals 86, and memory 88. Transistor switch arrays 82 each include the charge and discharge switches 50, 54 for 64 droplet ejection devices 10.

FPGAs 80 each include logic to provide pulses 64, 66 for respective piezoelectric actuators 38 at the desired times. D0–D7 data inputs 70 are used to set up the timing for individual switches 50, 54 in FPGAs 80 so that the pulses start and end at the desired times in a print cycle 68. Where the same size droplet will be ejected from an ejection device throughout a run, this timing information only needs to be entered once, over inputs D0–D7, prior to starting a run. If droplet size will be varied on a drop-by-drop basis, e.g., to provide gray scale control, the timing information will need to be passed through D0–D7 and updated in the FPGAs at the beginning of each print cycle. Input D0 alone is used during printing to provide the firing information, in a serial bit stream, to identify which droplet ejection devices 10 are operated during a print cycle. Instead of FPGAs other logic devices, e.g., discrete logic or microprocessors, can be used.

Resistor arrays 84 include resistors 52, 56 for the respective droplet ejection devices 10. There are two inputs and one output for each of 64 ejection devices controlled by an array 84.

Programming port 76 can be used instead of D0–D7 data input 70 to input data to set up FPGAs 80. Memory 88 can be used to buffer or prestore timing information for FPGAs 80.

In operation under a normal printing mode, the individual droplet ejection devices 10 can be calibrated to determine appropriate timing for pulses 64, 66 for each device 10 so that each device will eject droplets with the desired volume and desired velocity, and this information is used to program FPGAs 80. This operation can also be employed without calibration so long as appropriate timing has been determined. The data specifying a print job are then serially transmitted over the D0 terminal of data input 72 and used to control logic in FPGAs to trigger pulses 64, 66 in each print cycle in which that particular device is specified to print in the print job.

In a gray scale print mode, or in operations employing drop-by-drop variation, information setting the timing for each device 10 is passed over all eight terminals D0–D7 of data input 70 at the beginning of each print cycle so that each device will have the desired drop volume during that print cycle.

FPGAs 80 can also receive timing information and be controlled to provide so-called tickler pulses of a voltage that is insufficient to eject a droplet, but is sufficient to move the meniscus and prevent it from drying on an individual ejection device that is not being fired frequently.

FPGAs 80 can also receive timing information and be controlled to eject noise into the droplet ejection information so as to break up possible print patterns and banding.

FPGAs 80 can also receive timing information and be controlled to vary the amplitude (i.e., Vpzt_finish) as well as the width (time between charge and discharge pulses 64, 66) to achieve, e.g., a velocity and volume for the first droplet out of an ejection device 10 as for the subsequent droplets during a job.

The use of two resistors 52, 56, one for charge and one for discharge, permits one to independently control the slope of ramping up and down of the voltage on piezoelectric actuator 38. Alternatively, the outputs of switches 50, 54 could be joined together and connected to a common resistor that is connected to piezoelectric actuator 38 or the joined together output could be directly connected to the actuator 38 itself, with resistance provided elsewhere in series with the actuator 38.

By charging up to the desired voltage (Vpzt_finish) and maintaining the voltage on the piezoelectric actuators 38 by disconnecting the source voltage Xvdc and relying on the actuator's capacitance, less power is used by the print head than would be used if the actuators were held at the voltage (which would be Xvdc) during the length of the firing pulse.

For example, a switch and resistor could be replaced by a current source that is switched on and off. Also, common circuitry (e.g., a switch and resistor) could be used to drive a plurality of droplet ejection devices. Also, the drive pulse parameters could be varied as a function of the frequency of droplet ejection to reduce variation in drop volume as a function of frequency. Also, a third switch could be associated with each pumping chamber and controlled to connect the electrode of the piezoelectric actuator 38 to ground, e.g., when not being fired, while the second switch is used to connect the electrode of the piezoelectric actuator 38 to a voltage lower than ground to speed up the discharge.

It is also possible to create more complex waveforms. For example, switch 50 could be closed to bring the voltage up to V1, then opened for a period of time to hold this voltage, then closed again to go up to voltage V2. A complex waveform can be created by appropriate closings of switch 50 and switch 54.

Figure 6:
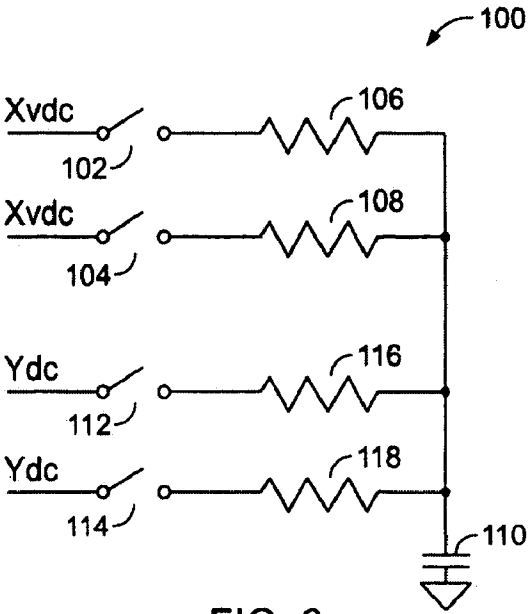
FIG. 6 illustrates a schematic showing an alternative implementation of electrical components associated with the individual droplet ejection device.
Figure 7:
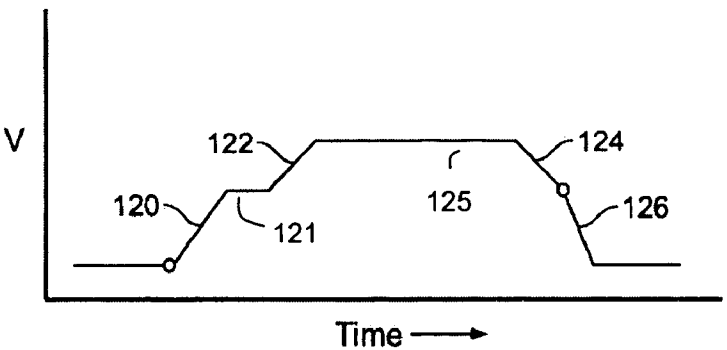
FIG. 7 illustrates a timing diagram for the operation of the FIG. 6 electrical components.

Multiple resistors, voltages, and switches could be used per droplet ejection device to get different slew rates as shown in FIGS. 6 and 7. Each droplet ejection device can include one or more resistances connected in parallel between the electric source and the electrically actuated displacement device. A switch can be placed in the path of the electric source and each of the one or more resistances to control the effective resistance of the parallel resistances when charging the device. Alternatively, the resistance can be part of the switch. For example, the resistance may be the source-to-drain resistance of a MOS-type (metal-oxide semiconductor) switch, and the MOS switch may be actuated by switching a voltage on the gate of the switch. Each droplet ejection device can include one or more resistances connected in parallel between the discharging electrical terminal and the electrically actuated displacement device. A switch can be placed in the path of the discharging electric terminal and each of the one or more resistances to control the effective resistance of the parallel resistances when discharging the device.

FIG. 6 shows an alternative control circuit 100 for an injection device in which multiple (here two) charging control switches 102, 104 and associated charging resistors 106, 108 are used to charge the capacitance 110 of the piezoelectric actuator and multiple (here two) discharging control switches 112, 114 and associated discharging resistors 116, 118 are used to discharge the capacitance.

The control circuit 100 can serve as a low-pass filter for incoming waveforms. The low-pass filter can filter high-frequency harmonics to result in a more predictable and consistent firing sequence for a given input. In one implementation, the time constant of the low-pass filter can be stated as "Reff×C", in which Reff is the effective resistance of the resistors that are connected in parallel and C is the capacitance of capacitor 110. Because Reff can be adjusted depending on which switches are actively connected in parallel, the time constant of the low-pass In one implementation, the switches that are activated in the circuit are selected before the waveform is applied to the input of the circuit. In this implementation, effective resistance is fixed during the entire duration of the firing interval. Alternatively, the switches can be activated during the duration of the firing interval. In this alternative implementation, a waveform applied at the input of the circuit can shaped by varying the response of the circuit. The response of the circuit can vary according to the effective resistance, Reff, which can be selected at various instances during the firing interval by selecting which switches are connected in the circuit.

In another implementation, a single waveform can be applied across all of the resistances in each resistor's respective path in which the respective switch of the path is activated. Alternatively, the path of each resistor may use a different waveform in which the respective switch of the respective path is activated. In this case, the resultant waveform at the device can be a superposition of multiple waveforms. In this aspect, waveforms can be provided that are not stored in the waveform table. Hence, waveforms can be supplied from waveform data stored in the waveform table, as well as waveforms that are generated as a result of waveforms that are superimposed across a set of parallel resistor paths. In this aspect, the amount of memory to store a waveform table on the print head can be minimized to generate a limited number of basic waveform patterns, and the control switches can be use to generate additional and/or complex waveform patterns. As a result, a droplet ejection device can have a response that is trimmed or adjusted based on stored waveform data and/or mechanical data for control switches.

Figure 8A:
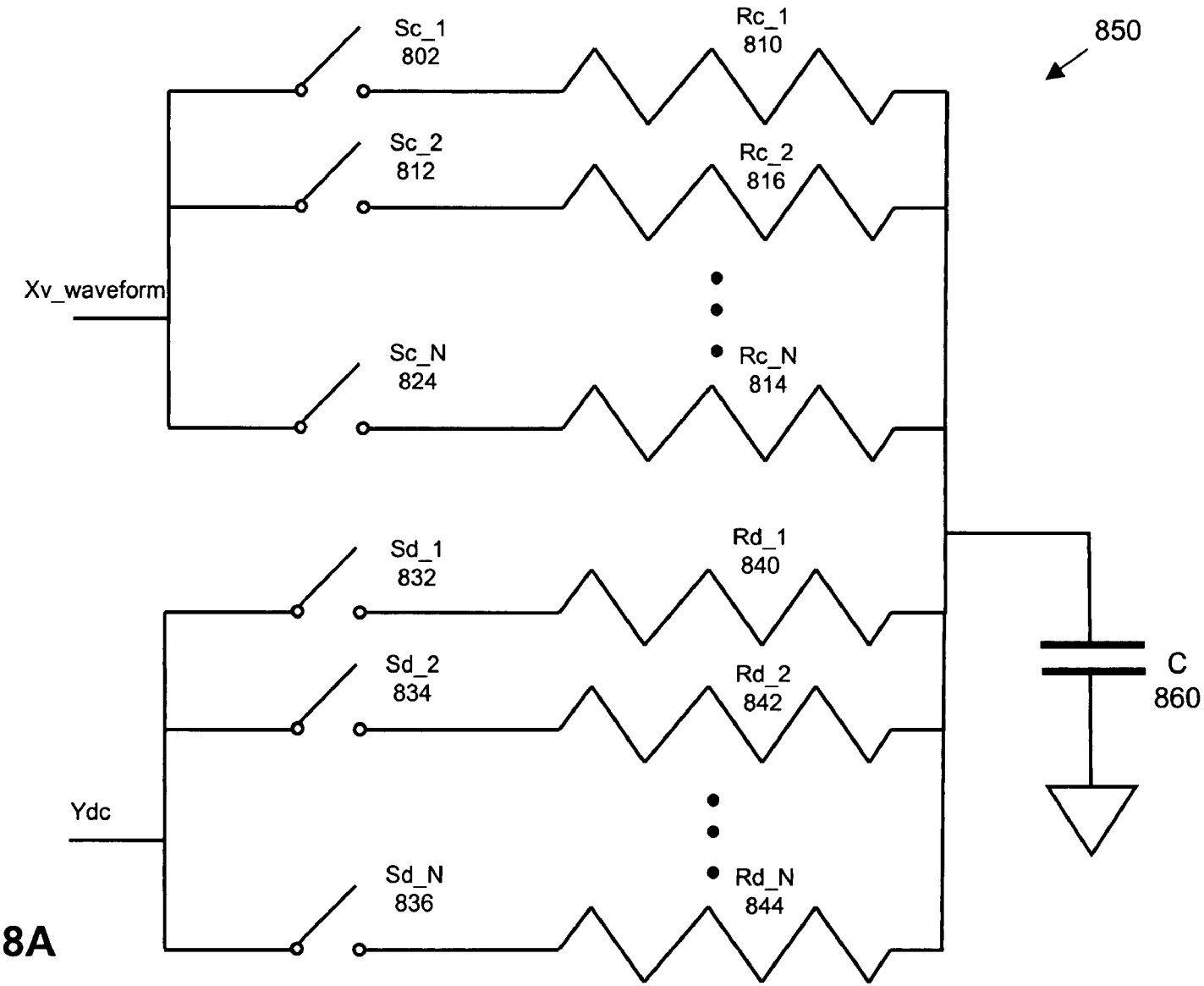
FIGS. 8A–8B illustrate schematics showing an alternative implementation of electrical components associated with the individual droplet ejection device.

FIG. 8A illustrates a schematic showing an alternative implementation of electrical components associated with an individual droplet ejection device. FIG. 8A shows an alternative control circuit 850 for an injection device in which multiple (here N) charging control switches Sc_1 802, Sc_2 812, and Sc_N 824 and associated charging resistors Rc_1 810, Rc_2 816, and Rc_N 814 are used to charge the capacitance C 860 of the piezoelectric actuator and multiple (here N) discharging control switches Sd_1 832, Sd_2 834, Sd_N 836 and associated discharging resistors Rd_1 840, Rd_2 842, and Rd_N 844 are used to discharge the capacitance.

FIG. 7 can also show the resulting voltage charge on the capacitance for one cycle of a square-pulse waveform Xv_waveform if the waveform is applied prior to 120 and removed after 126. For example, the ramp up at 120 can be created by having switch 802 closed while the filter can vary and the resulting waveform across the capacitor 110 can be adjusted (e.g., shaped) accordingly.

The slope of the ramp during the charging phase can be determined by the amount of current that can be delivered to charge or discharge the capacitor 110. The charging (or discharging) of the capacitor 110 is limited by the amount of current that the internal circuitry (not shown) driving the control circuit 100 can deliver to the control circuit 100 to charge (or discharge) the capacitor 110. The "slew rate" can refer to the rate the capacitor 110 charges (or discharges), and can determine the slope of the charging (or discharging). In one aspect, the slew rate can be stated as the ratio of the current to capacitance (Slew rate=I/C). Alternatively, the slew rate can be stated as the change in voltage across the capacitor 110 divided by the effective resistance multiplied by the capacitance (Slew Rate=ΔV/(Reff*C)). Therefore, the slew rate and the slope of the charging and discharging can be adjusted by varying Reff. For example, if switches 102 and 104 are closed, Reff may represent the effective resistance of the parallel combination of resistors 106 and 108. However, if switch 102 is open and switch 104 is closed, then Reff can represent the resistance of resistor 108.

FIG. 7 shows a timing diagram of the resulting voltage on the actuator capacitor based on a constant input voltage applied at the input Xvdc. The ramp up at 120 is caused by having switch 102 closed while the other switches are open. The flat portion at 121 represents the voltage across a partially-charged capacitor, in which all the switches are open after having switch 102 partially charge the capacitor during 120. The ramp up at 122 is caused by having switch 104 closed while the other switches are open. The flat portion at 125 represents a fully-charged capacitor, in which the value of the input voltage Xvdc is across the capacitor 110. When the voltage across the capacitor 110 has reached the final voltage, Xvdc, all of the switches in the circuit can be opened to save power. At this point, the capacitor 110 effectively "holds" the voltage Xvdc because the charge on the capacitor does not change. The ramp down at 124 is caused by having switch 112 closed while the other switches are open. The ramp down at 126 is caused by having switch 114 closed while the other switches are open. The slopes of the ramps up 120, 122 and the slopes of the ramps down 124, 126 can vary depending on the resistance of the switch that is being activated. Although FIG. 7 shows one switch being activated at one time, more than one switch can be activated at the same time to vary the effective resistance, and the slope of the ramps. other switches are open. The ramp up at 812 can be created by having switch 104 closed while the other switches are open. The ramp down at 124 can be formed by having switch 832 closed while the other switches are open. The ramp down at 126 can be formed by having switch 834 closed while the other switches are open. Alternatively, any number of switches may be open or closed during ramp up or ramp down. Also, multiple switches may be open or closed during the ramp up or ramp down.

In one implementation, all the resistors in the control circuit 850 are of the same resistance. In another implementation, the resistors in the control circuit 850 are of different resistances. For example, the charging resistors Rc_1 810, Rc_2 816, and Rc_N 814 and corresponding discharging resistors Rd_1 840, Rd_2 842, and Rd_N 844 discharging resistors are binary-weighted resistors, in which a resistance in a (parallel) path can vary by a factor of two from a resistor in another (parallel) path. Alternatively, each resistor can have a resistance to allow the effective resistance, Reff, to vary by factors of 2 (e.g., Reff can be R, 2R, 4R, 8R, 32R, etc.).

Figure 8B:
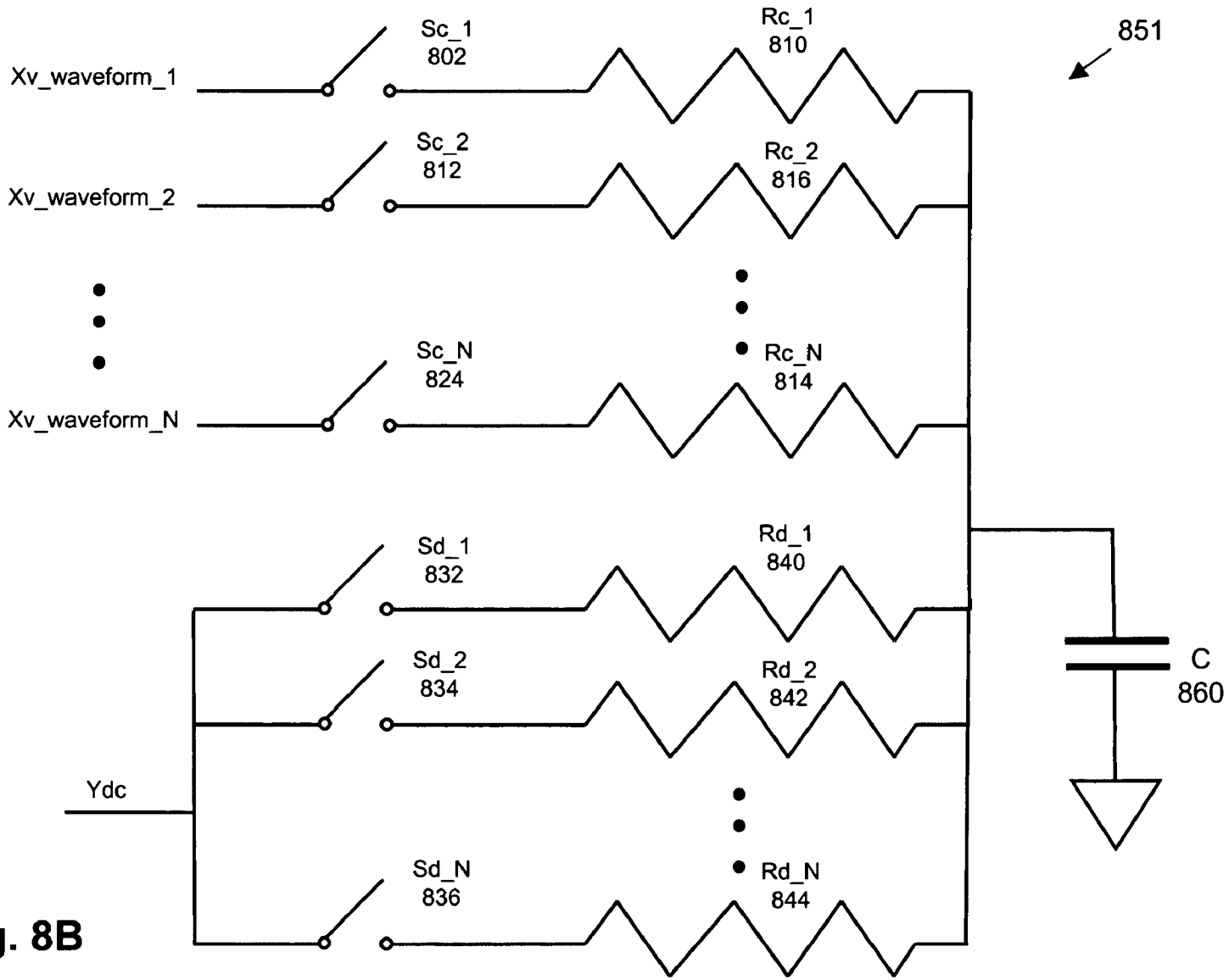

FIG. 8B illustrates a schematic showing an alternative implementation of electrical components associated with an individual droplet ejection device. FIG. 8B shows an alternative control circuit 851 for an injection device in which multiple (here N) charging control switches Sc_1 802, Sc_2 812, and Sc_N 824 and associated charging resistors Rc_1 810, Rc_2 816, and Rc_N 814 are used to charge the capacitance C 860 of the piezoelectric actuator and multiple (here N) discharging control switches Sd_1 832, Sd_2 834, Sd_N 836 and associated discharging resistors Rd_1 840, Rd_2 842, and Rd_N 844 are used to discharge the capacitance. Multiple waveforms (e.g., Xv_waveform_1, Xv_waveform_2, and Xv_waveform_N) can be used as input waveforms into the control circuit 851 to generate a superimposed waveform across the capacitor C 860.

In FIG. 8A, one waveform is used as a common waveform for each switch-resistance path. For example, the path of Sc_1 802 and Rc_1 810 has the same waveform at the input of the switch Sc_1 802 as switch Sc_2 812 for path of Sc_2 812 and Rc_2 816. In FIG. 8B, each charging control switch Sc_1 802, Sc_2 812, Sc_N 824 can have a different waveform (e.g., Xv_waveform_1, Xv_waveform_2, and Xv_waveform_N) at the input of the switch. Hence, each switched-resistance path (e.g., path for Sc_1 802 and Rc_1 810, path for Sc_2 812 and Rc_2 816, and path for Sc_N 824 and Rc_N 814) can have a different waveform across the path.

In one implementation, the parallel switches may not increase an overall area of the die of the circuit in FIG. 6 (or FIGS. 8A, 8B) when compared to using a single switch as shown in FIG. 3. In another implementation, the power required by the circuit in FIG. 6 (or FIGS. 8A, 8B) may not increase power dissipated in the design of the circuit shown in FIG. 3.

Figure 9:
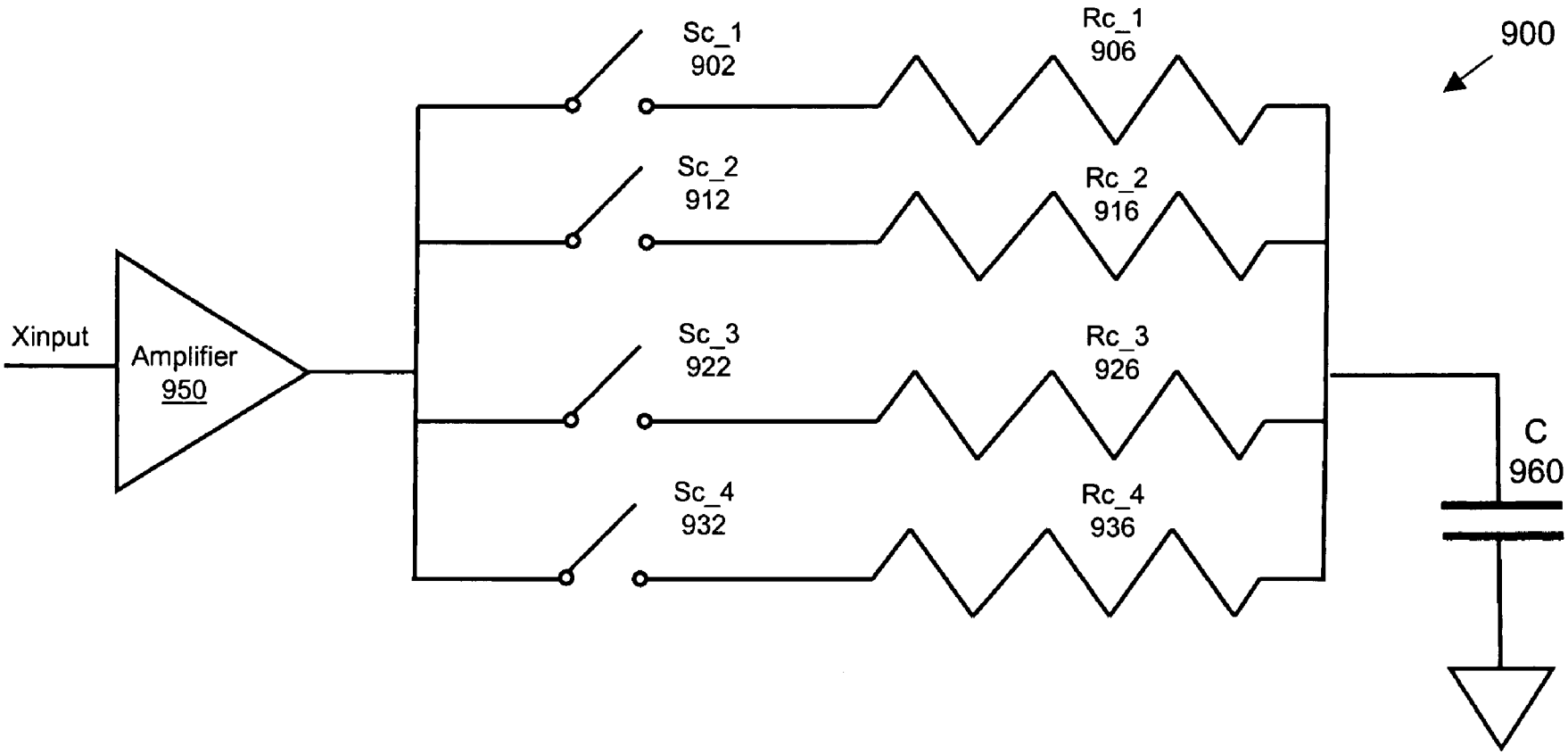
FIG. 9 illustrates a schematic showing an implementation of electrical components associated with the droplet ejection device.

FIG. 9 illustrates another schematic showing an alternative implementation of electrical components associated with the individual droplet ejection device. FIG. 9 shows a control circuit 900 for an injection device in which multiple (here 4) control switches Sc_1 902, Sc_2 912, Sc_3 922, and Sc_4 932 and associated resistors Rc_1 906, Rc_2 916, Rc_3 926, and Rc_4 936 are used to charge and discharge the capacitance C 960 of the piezoelectric actuator. Instead of using separate discharging control switches and associated discharging resistors as shown in FIGS. 3, 6, 8A, and 8B, an amplifier 950 can be used to drive an input signal, Xinput, to charge and discharge capacitance C 960 using control switches Sc_1 902, Sc_2 912, Sc_3 922, and Sc_4 932 and associated resistors Rc_1 906, Rc_2 916, Rc_3 926, and Rc_4 836. The amplifier 950 can supply both the charging current and the discharging current for the capacitor C 960. The input signal, Xinput, may be a constant voltage input (i.e., DC input) or may be another type of waveform, such as a sawtooth waveform, or a sinusoidal-type waveform, and the like. In one implementation, each of the control switches can be preset to an opened or closed position before the input signal is applied and driven by the amplifier 950. After the input signal has been applied and the capacitance C 960 has been charged or discharged to a final value by the amplifier 950, each of the control switches can be reset to a different opened or closed position for a successive input signal to be applied to the circuit 900. The successive input signal may be a same type of input signal as applied for the previous signal, or may be a different type of input signal, such as a sawtooth waveform followed by a sinusoidal-type waveform.

Other implementations of the disclosure are within the scope of the appended claims. For example, the switch and resistor can be discrete elements or may be part of a single element, such as the resistance of a field-effect transistor (FET) switch. The resistances shown in FIGS. 3, 6, 8A–B, and 9 can be designed based on the power dissipation of the droplet ejection device. In another example, the resistances shown in FIGS. 3, 6, 8A–B, and 9 can be designed based on the effective charging and/or discharging time constant of the droplet ejection device.

What is claimed is:

1. A method to control a response of a droplet ejection device comprising a plurality of switches and a piezoelectric actuator, the method comprising:

connecting the plurality of switches in parallel, each of the plurality of switches having a resistance;

connecting the plurality of switches to the piezoelectric actuator having a capacitance, arranging the resistance from each of the plurality of switches and the capacitance of the piezoelectric actuator to form a low-pass filter circuit; and each switch comprises an input terminal to connect to a waveform signal, an output terminal to connect to the piezoelectric actuator, a control signal terminal to control a connection of the switch with a control signal, and a resistance between the input terminal and output terminal;

selecting from a waveform table a waveform signal to apply to the input terminal of each of the plurality of switches the waveform signal comprising any of a step pulse, a sawtooth waveform, and a combination of two or more waveform patterns;

applying the selected waveform signal on the input terminal of each of the plurality of switches, wherein each of the plurality of switches are connected at a common output terminal at the piezoelectric actuator;

controlling the control signal terminal of each switch with the control signal;

filtering high-frequency harmonics with the low-pass filter circuit to provide firing waveforms at the actuator that are consistent for a same pattern of input waveform signal; controlling the control signal terminal of each of the one or more of the switches of the low-pass filter circuit to form an effective resistance, Reff, for the low-pass circuit that is based on one or more resistors connected in parallel, wherein the effective resistance comprises a parallel combination of switches that are active in the low-pass filter circuit, wherein an active switch comprises a switch with a high voltage on the control signal terminal of the switch and the switch is electrically connected.

2. The method of claim 1, further comprising an electrically actuated displacement device configured to move between a displaced position and an undisplaced position in change the volume of a fluid chamber as a charge associated with the piezoelectric actuator changes between an actuated condition and an unactuated condition, and wherein the fluid chamber comprises a volume and an ejection nozzle.

3. The method of claim 1, wherein the waveform signal is selected for the input terminal of at least two switches.

4. The method of claim 1, further comprising varying a frequency response of the low-pass filter circuit by varying a selection or activated switches.

5. The method of claim 1, wherein the method further comprises including one or more parameters in the waveform table to compensate for inkjet direction variability between ink nozzles.

6. The method of claim 1, further comprising including one or more parameters in the waveform table to increase print control, produce different responses, and produce different spot sizes for each print job.

7. The method of claim 6, wherein the one or more parameters comprise parameters that are based on one or more types of substrates and the ink absorption rate for the one or more types of substrate.

8. The method of claim 1, further comprising configuring the low-pass filter circuit to form the effective resistance before applying a waveform signal to the input terminal of any of the switches.

9. The method of claim 8, further comprising electrically disconnecting one or more of the switches after a duration of a waveform firing interval.

10. A method to control a response of a droplet ejection device comprising a plurality of switches and a piezoelectric actuator, the method comprising:

connecting the plurality of switches to the piezoelectric actuator having a capacitance, the plurality of switches comprise binary-weighted switches; the plurality of switches being connected in parallel, the resistance from each of the plurality of switches and the capacitance of the piezoelectric actuator being arranged to form a low-pass filter circuit; and each switch comprises an input terminal to connect to a waveform signal, an output terminal to connect to the piezoelectric actuator, a control signal terminal to control a connection of the switch with a control signal, and a resistance between the input terminal and output terminal;

selecting a waveform signal to apply to the input terminal of each of the plurality of switches;

applying the selected waveform signal on the input terminal of each of the plurality of switches, wherein the waveform signal comprises any of a step pulse, a sawtooth waveform, and a combination of two or more waveform patterns, and the each of the plurality of switches are connected at a common output terminal at the piezoelectric actuator;

controlling the control signal terminal of each switch with the control signal;

filtering high-frequency harmonics with the low-pass filter circuit to provide firing waveforms at the actuator that are consistent for a pattern of input waveform signal;

controlling the control signal terminal of each of the one or more of the switches of the low-pass filter circuit to form an effective resistance, Reff, for the low-pass circuit that is based on one or more resistors connected in parallel, wherein the effective resistance comprises a parallel combination of switches that are active in the low-pass filter circuit, wherein an active switch comprises a switch with a high voltage on the control signal terminal of the switch and the switch is electrically connected.

11. An apparatus comprising:

a plurality of droplet ejection devices, each droplet ejection device comprising:

a plurality of switches connected in parallel to a piezoelectric actuator, wherein each switch comprises an input terminal to connect to an input waveform signal, an output terminal to connect to the piezoelectric actuator, a control signal terminal to control a connection of the switch with a control signal, and a resistance between the input terminal and output terminal; and a set of waveform signal information that includes the input waveform signal to an input of each of the plurality of droplet ejection devices, the set of waveform signal information comprising information for one or more waveform patterns, wherein the waveform patterns comprise a step pulse, a sawtooth waveform, or a combination of two or more waveform patterns;

an amplifier connected to the input terminal of at least one of the switches to drive the piezoelectric actuator connected to the output terminal with the input waveform signal, wherein the amplifier is configured to charge a capacitance of the piezoelectric actuator, and wherein the amplifier is further configured to discharge a capacitance of the piezoelectric actuator; and a controller to provide respective charge control signals to respective control signal terminals to control an extent of change in charge for for capacitance for the piezoelectric actuator.

12. The apparatus of claim 11, wherein the resistance from each of the plurality of switches and the capacitance of the piezoelectric actuator is configured to form a low-pass filter circuit to filter high-frequency harmonics associated with the input waveform signals.

13. The apparatus of claim 12, wherein the resistance of each switch in the low-pass filter circuit is configured to be connected in parallel to form an effective resistance, Reff, for the low-pass circuit.

14. The apparatus of claim 12, wherein the low-pass filter circuit is configured to vary the effective resistance based on a selection of which of the plurality of switches are electrically connected so the input waveform signal and the piezoelectric actuator.

15. The apparatus of claim 11, wherein the waveform signal information is derived from a waveform table.

16. A system to control printing of an inkjet printer, the system comprising:

a filter circuit to filter high-frequency signals in input waveform signals, wherein the filter circuit is configured to provide stable firing waveform signals for an actuator for ink droplet ejection, the filter circuit comprising;

an effective resistance formed from a plurality of resistors electrically connected in parallel, wherein a first end of the parallel connection is connected to an input waveform terminal and a second end of the parallel connection is connected to the actuator for ink droplet ejection; and a plurality of switches, wherein at least one switch is configured to connect at least one of the plurality of resistors in parallel with another resistor, and wherein each switch is configured to be electrically connected in series with a resistor; and a controller to control which of the plurality of switches are electrically connected to determine a resistance value for the effective resistance, wherein a frequency response of the filter circuit is related to the effective resistance and a capacitance of the actuator.

17. The system of claim 16, wherein each switch comprises the resistor.

18. The system of claim 16, wherein input waveform signals comprise any of a step pulse, a sawtooth waveform, and a combination of two or more waveform patterns.

19. The system of claim 16, further comprising an amplifier connected to the input waveform terminal to drive the actuator with a firing waveform signal, wherein the amplifier is configured to charge a capacitance of the actuator, and wherein the amplifier is further configured to discharge a capacitance of the actuator.

* * * * *

UNITED STATES PATENT AND TRADEMARK OFFICE

CERTIFICATE OF CORRECTION

PATENT NO. : 7,234,788 B2
APPLICATION NO. : 10/981072
DATED : June 26, 2007
INVENTOR(S) : Deane A. Gardner It is certified that error appears in the above-identified patent and that said Letters Patent is hereby corrected as shown below:

Change "FGPA" to --FPGA-- in col. 2, line 42; col. 5, line 38.

Change "data input 72" to --data input 70-- in col. 6, line 41.

Change "injection" to --ejection-- in col. 7, line 52; col. 8, line 36; col. 9, line 54; col. 10, line 21.

Signed and Sealed this

Eighteenth Day of March, 2008

JON W. DUDAS
*Director of the United States Patent and Trademark Office*